US007658280B2

(12) United States Patent
Bardet et al.

(10) Patent No.: US 7,658,280 B2
(45) Date of Patent: Feb. 9, 2010

(54) HINGED LID CONTAINER WITH SLIDING DEVICE

(75) Inventors: Pierre-Alain Bardet, Les Tuileries-de-Granson (CH); Philippe Bourgoin, Cheseaux (CH); Kevin Brügger, Kappe (CH)

(73) Assignee: Philip Morris USA Inc., Richmond, VA (US)

( * ) Notice: Subject to any disclaimer, the term of this patent is extended or adjusted under 35 U.S.C. 154(b) by 239 days.

(21) Appl. No.: 11/785,858

(22) Filed: Apr. 20, 2007

(65) Prior Publication Data

US 2007/0251984 A1 Nov. 1, 2007

(30) Foreign Application Priority Data

Apr. 20, 2006 (EP) ..... 06112825

(51) Int. Cl.
*B65D 5/00* (2006.01)

(52) U.S. Cl. ..... 206/267; 206/264

(58) Field of Classification Search ..... 206/267, 206/264, 266, 265, 268, 271, 273, 278; 229/125.37
See application file for complete search history.

(56) References Cited

U.S. PATENT DOCUMENTS

| | | | | |
|---|---|---|---|---|
| 439,993 | A | 11/1890 | Bailey | |
| 664,141 | A | 12/1900 | Fredrikson | |
| 1,962,468 | A | 6/1934 | Stein | |
| 2,279,614 | A | 4/1942 | Bryant | |
| 2,285,188 | A | 6/1942 | Cobbs | |
| 2,597,810 | A | 5/1952 | Myers | |
| 2,950,060 | A * | 8/1960 | Von Rudeen | 206/267 |
| 2,990,994 | A | 7/1961 | Hackmeyer | |
| 3,096,878 | A * | 7/1963 | Whitley et al. | 206/246 |
| 3,132,790 | A * | 5/1964 | Capuccio | 206/268 |

(Continued)

FOREIGN PATENT DOCUMENTS

DE 2809548 A1 9/1978

(Continued)

OTHER PUBLICATIONS

European Search Report for EP 06112825 dated Oct. 9, 2006.

(Continued)

*Primary Examiner*—Jacob K Ackun, Jr.
*Assistant Examiner*—King M Chu
(74) *Attorney, Agent, or Firm*—Buchanan Ingersoll & Rooney PC

(57) ABSTRACT

A container includes a lower box portion, an upper lid portion, and a sliding portion. The lower box portion includes a box bottom wall, a box front wall and a box back wall. The upper lid portion is hinged to the box back wall. The sliding device at least partially covers the lower box portion. The container is opened by moving the sliding device in one direction and closed by moving the sliding device in a second, opposite direction along the lower box portion. The box back wall includes a first stopper flap to limit movement of the sliding device in the first direction, and a second stopper flap to limit movement of the sliding device in the second direction. The first and second stopper flaps are formed by a common cut or incision. Two blanks may be used for the box and sliding device.

14 Claims, 5 Drawing Sheets

U.S. PATENT DOCUMENTS

Figure 1:
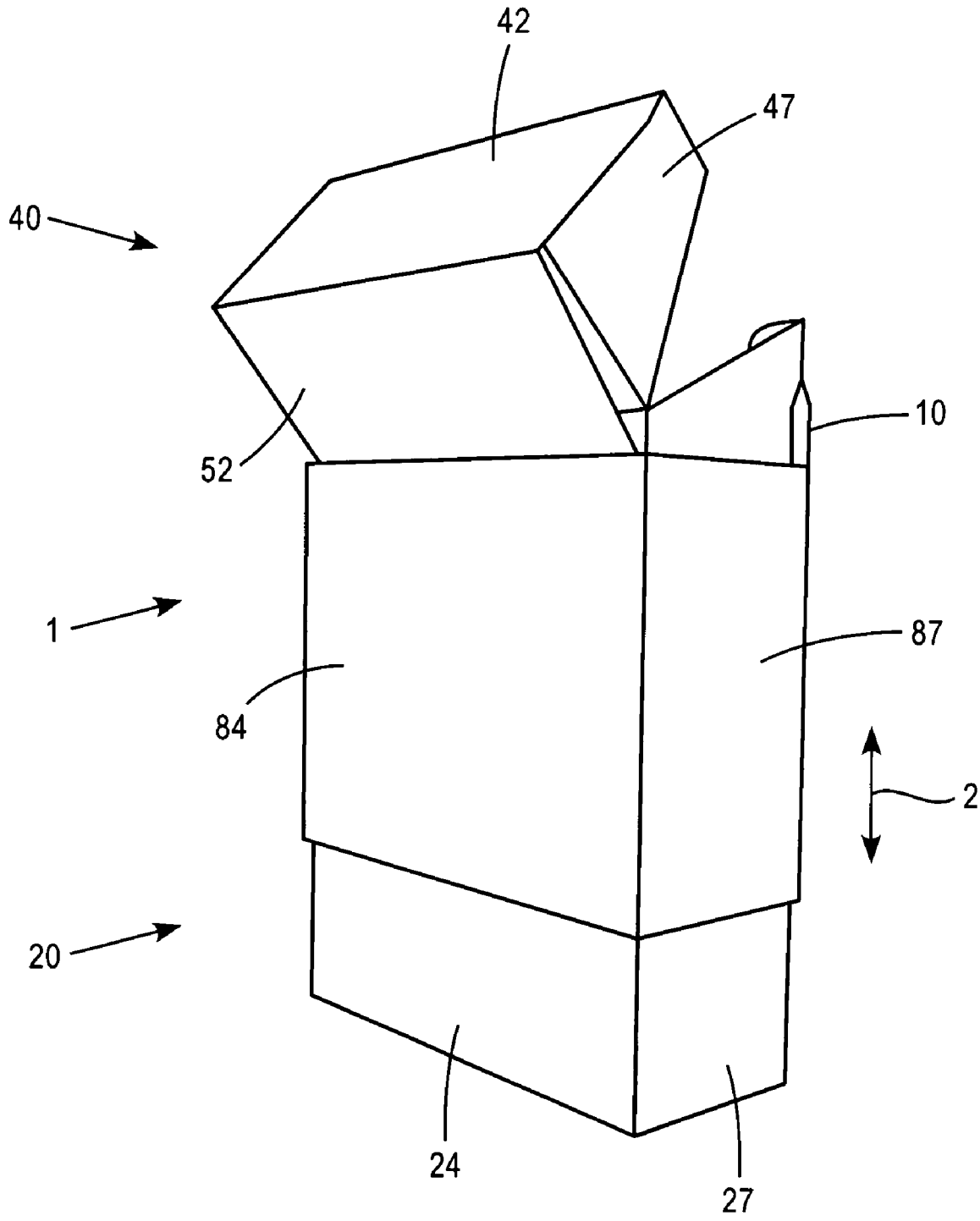

| | | | | |
|---|---|---|---|---|
| 3,311,283 | A * | 3/1967 | Shimada et al. | 229/125.08 |
| 3,400,874 | A * | 9/1968 | Shimada et al. | 206/250 |
| 3,858,788 | A | 1/1975 | Phillips, Jr. | |
| 3,933,299 | A * | 1/1976 | Shimada et al. | 229/125.37 |
| 4,049,117 | A * | 9/1977 | Grimm | 206/270 |
| 4,267,926 | A | 5/1981 | Toimil | |
| 4,646,960 | A * | 3/1987 | Challand | 206/259 |
| 5,301,805 | A | 4/1994 | Evers et al. | |
| 2005/0224374 | A1 | 10/2005 | Petrucci et al. | |

FOREIGN PATENT DOCUMENTS

| | | | |
|---|---|---|---|
| DE | 2916372 | A1 | 2/1980 |
| EP | 0582488 | A1 | 2/1994 |
| JP | 10-35644 | | 10/1998 |
| LU | 80049 | | 2/1980 |

OTHER PUBLICATIONS

International Search Report dated Jun. 18, 2007 for PCT/EP2007/053905.

Second International Search Report dated Mar. 20, 2008 for PCT/EP2007/053905.

International Preliminary Report on Patentability dated Oct. 22, 2008 for PCT/EP2007/053905.

* cited by examiner

HINGED LID CONTAINER WITH SLIDING DEVICE

CROSS REFERENCE TO RELATED APPLICATION

This application claims priority under 35 U.S.C. §119 to European Application No. 06112825.2, filed Apr. 20, 2006, the entire content of which is hereby incorporated by reference.

The invention relates to a novel hinge-lid container comprising a sliding device and in particular to a novel hinge-lid container or carton for consumer goods, for example elongate smoking articles such as cigarettes.

Smoking articles such as cigarettes and a variety of other consumer goods are commonly sold in hinge-lid containers. These hinge-lid containers comprise a lower box portion and an upper lid portion, which is hinged to the back wall of the lower box portion. Such containers are formed from laminar cardboard blanks that include various panels and flaps, which when folded about appropriate score lines around a pre-wrapped bundle of cigarettes form the lower box portion and the upper lid portion of the hinge-lid container.

In conventional hinge-lid cigarette containers, the upper lid portion of the container is hinged to the top of the back wall of the lower box portion thereof along a transverse hinge line and the cigarettes stand in the lower box portion of the upright container with their longitudinal axes parallel to the longitudinal axis of the container. When the consumer opens the container, by pivoting the front of the lid portion up and to the rear, the upper ends of the cigarettes standing in the lower box portion are exposed. In the closed position, the front wall, back wall and side walls of the upper lid portion of the hinge-lid container form vertical extensions of the corresponding walls of the lower box portion thereof.

Also known are hinge-lid containers comprising a sliding device embracing the lower box portion, wherein the hinge-lid is opened and closed by moving the sliding device along the box of the container. Such containers are disclosed for example in U.S. Pat. No. 3,400,874, U.S. Pat. No. 3,858,788 and U.S. Pat. No. 3,933,299.

According to the present invention there is provided a container comprising a lower box portion, an upper lid portion and a sliding device, wherein said lower box portion comprises a box bottom wall, a box front wall and a box back wall, wherein the upper lid portion is hinged to the box back wall, wherein the sliding device embraces at least partly the lower box portion, wherein the container is opened by moving the sliding device longitudinally along the lower box portion in a first direction and closed by moving the sliding device longitudinally along the lower box portion in a second, opposite direction, wherein the box back wall comprises a first stopper flap limiting the movement of the sliding device in the first direction and a second stopper flap limiting the movement of the sliding device in the second, opposite direction and wherein the first stopper flap and the second stopper flap are formed by a common incision.

When the container is placed on the box bottom wall the first direction of the longitudinal movement of the sliding device is downwards and the second direction of the longitudinal movement of the sliding device is upwards.

The upper lid portion comprises a lid flap, extending from the lid's top back edge in the first direction beyond the hinge of the upper lid portion and the lid flap further comprises a lid end flap, extending from the lower end of the lid flap which is bent upward.

The sliding device comprises a slide top edge, a slide bottom edge, a slide top flap extending from the slide top edge and a slide bottom flap extending from the slide bottom edge, wherein both slide flaps are bent inwardly. These flaps interact with the lid end flap of the upper lid portion.

When the sliding device is moved a given distance in the first direction the slide top flap contacts the lid end flap. When moving the sliding device further in the first direction the lid end flap is pulled along the sliding device. This opens the container by pivoting the upper lid portion backwards.

The movement of the sliding device is limited in the first direction by the contact of the lower end of the lid flap into the first stopper flap. The opening of the upper lid portion is likewise limited by the first stopper flap, as the sliding device cannot move the lid end flap past the first stopper flap. The opening angle of the lid is defined by the distance between the folding line of the lid flap and the folding line of the first stopper flap, corresponding to the distance the lid flap travels along the sliding device in the first direction.

In the second direction the movement of the sliding device is limited by the contact of the slide bottom flap with the second stopper flap.

Preferably the upper lid portion comprises a lid top panel and a lid side panel, wherein the lid top panel extends sideways over the lid side panel to limit movement of the sliding device in the second direction. This also improves the look of the container when closed as the sides are entirely covered by the lid top panel when looked on from above. Additionally this second limitation of the movement of the sliding device in the second direction reduces the wear on the second stopper flap.

Preferably the sliding device comprises a slide front panel and a slide inner front panel extending from the slide front panel, folded by 180 degrees into the sliding device. This advantageously adds structural strength to the sliding device. This makes the sliding device more resistant to wear and gives the container an improved look, particularly when closed.

Preferably the box further comprises a friction element to increase the friction between the box and the sliding device during the movement of the sliding device in either the first direction or the second direction. Depending on the size of the friction element, the sliding device has more or less friction when moved. The longer and higher the friction element is, the more friction is created when the sliding device is moved. A higher friction advantageously keeps the sliding device in place so it will not move due to gravity or other unwanted forces. A higher friction also gives the sliding device a better quality feeling.

Preferably the sliding device covers substantially half of the lower box portion. The container may then easily be opened by the consumer by holding the container in one hand and moving the sliding device down using for example his thumb, or by holding the sliding device with one hand and pushing the container with its bottom on a surface, for example a table.

According to a second aspect of the present invention there is provided a blank for making said lower box portion and the upper lid portion for the hinge-lid container of the invention. The blank comprises a back panel, wherein that back panel comprises an incision forming at least two stopper flaps pointing in opposite directions.

Preferably the lower box portion and the upper lid portion are made from one blank and the sliding device is made from a separate blank, wherein the two blanks are not adhered to each other.

All customary materials may be used as foldable materials for the blanks, particularly the papers and cardboards usually used for cigarette boxes, with or without coating, but also plastic materials. Different materials may be used for the two blanks, for example the sliding device blank may be made of plastic and the box blank may be made from cardboard. Alternatively, different cardboards may be used, for example cardboards with different thicknesses. Other differences in one or both blanks may be embossing the blank, printing on the blank in special colours or applying lacquer, metallization, holograms, luminescence or other materials changing the feel, odor or visual appearance of the blank. Additionally, one or both of the blanks, for example the sliding device blank, may be made of transparent material.

According to a third aspect of the invention the container according to the invention is a carton, containing a number of smaller containers, for example ten cigarette containers. Alternatively other consumer goods may be stored inside the container.

According to a further aspect of the present invention there is provided a container comprising a lower box portion, an upper lid portion and a sliding device, wherein said lower box portion comprises a box bottom wall, a box front wall and a box back wall, wherein the upper lid portion is hinged to the box back wall, wherein the sliding device embraces at least partly the lower box portion, wherein the container is opened by moving the sliding device longitudinally along the lower box portion in a first direction and closed by moving the sliding device longitudinally along the lower box portion in a second, opposite direction, wherein the box back wall comprises a first stopper flap limiting the movement of the sliding device in the first direction and a second stopper flap limiting the movement of the sliding device in the second, opposite direction, wherein the lower box portion is formed from a first blank and the upper lid portion is formed from a second blank. With this, the production of the container is greatly simplified. Due to the separation of the lower box portion and the upper lid portion, the production of the lower box portion is similar to the production of the lower portion of a common hinge lid container. As such, standard machinery may be used for the high speed production of this portion of the container.

This advantageously speeds up the entire production process. Additionally, the two blanks of the version of the lower box portion of the container need to be printed or coated only on one side as opposed to printing or coating on both sides for a container with a box portion formed from a single blank. This may advantageously reduce the production cost. Besides, the separation of the blank of the lower box portion and the upper lid portion may be used also for other packs, in particular for a slide and shell container wherein the first stopper flap and the second stopper flap are not formed by a common incision but with separate incisions.

Figure 2:
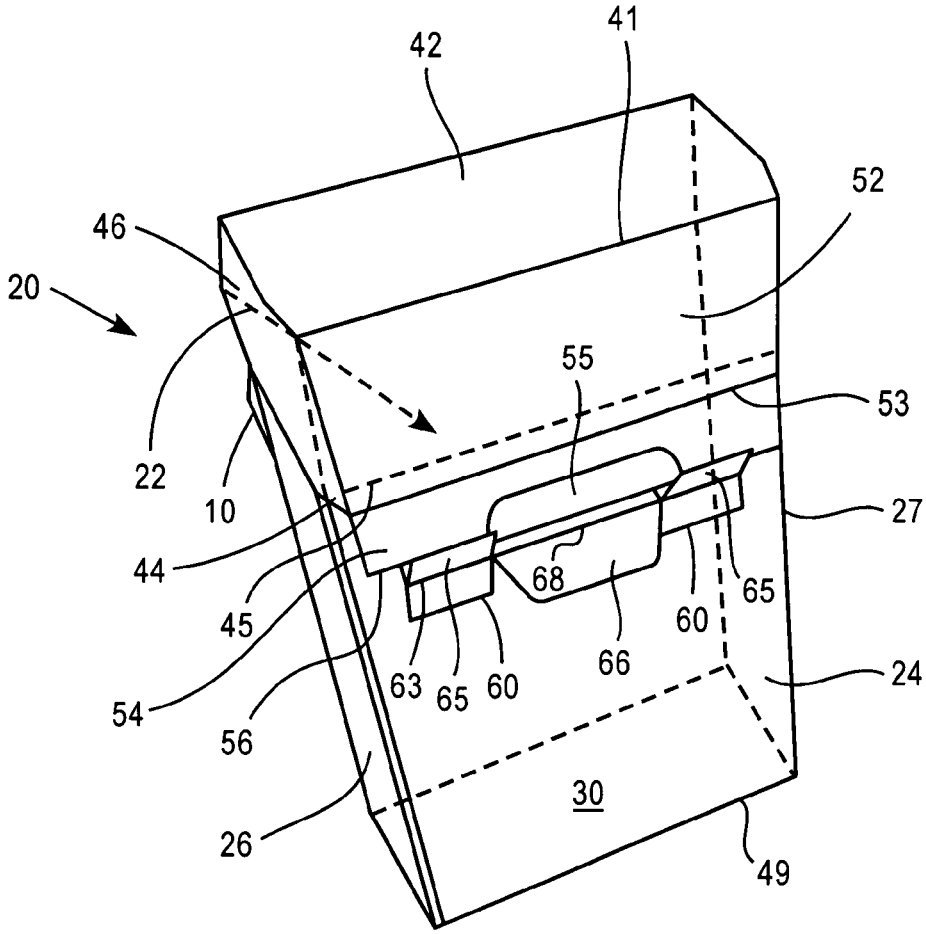
Figure 3:
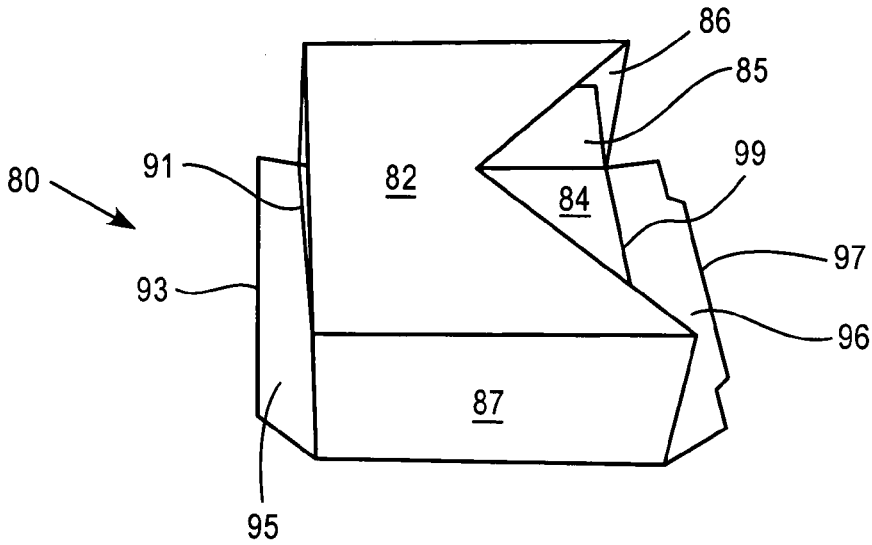
Figure 4:
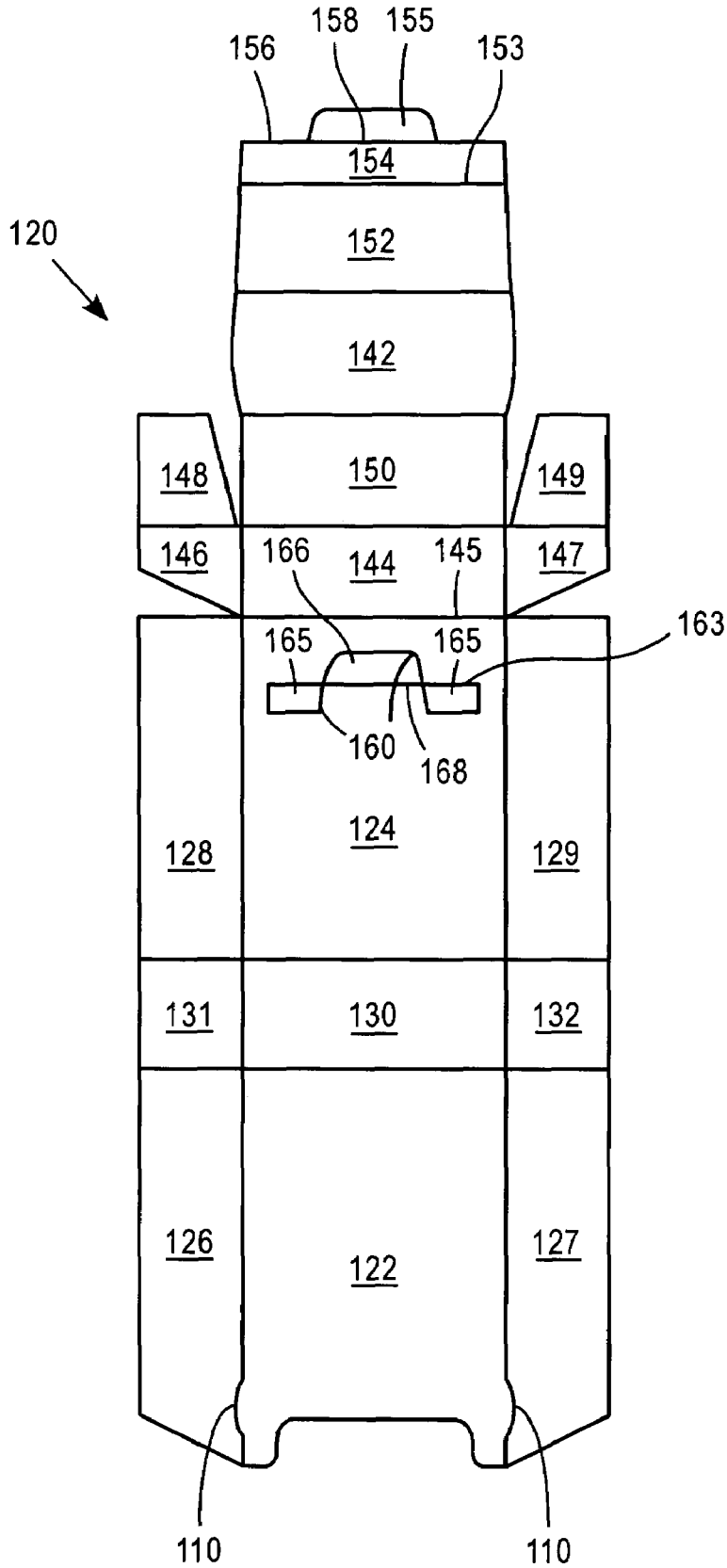
Figure 5:
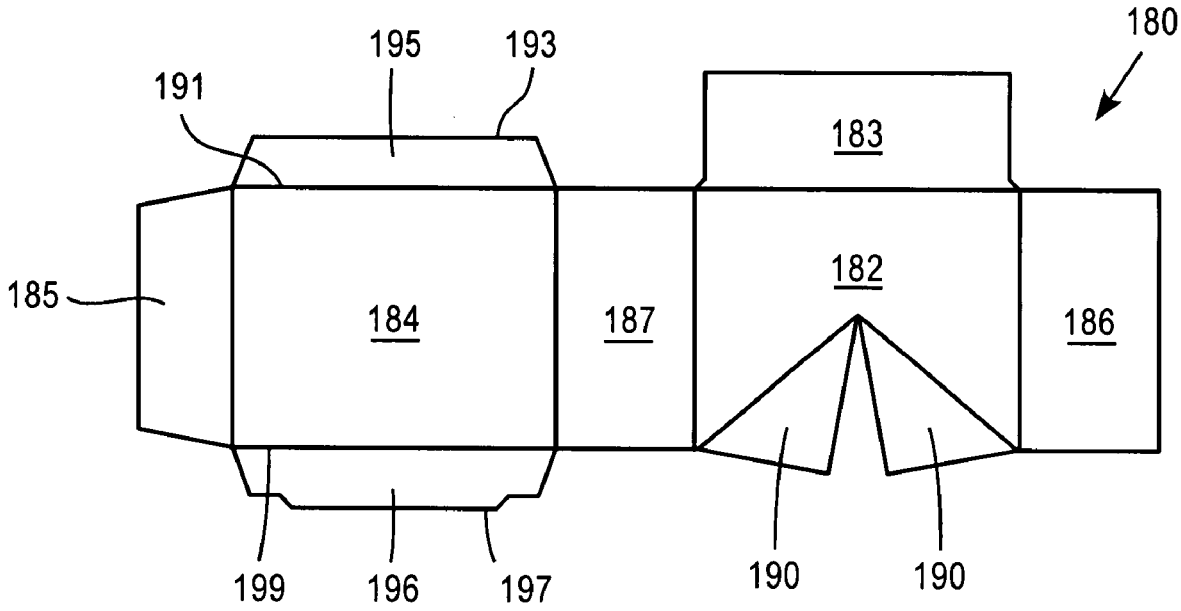
Figure 6A:
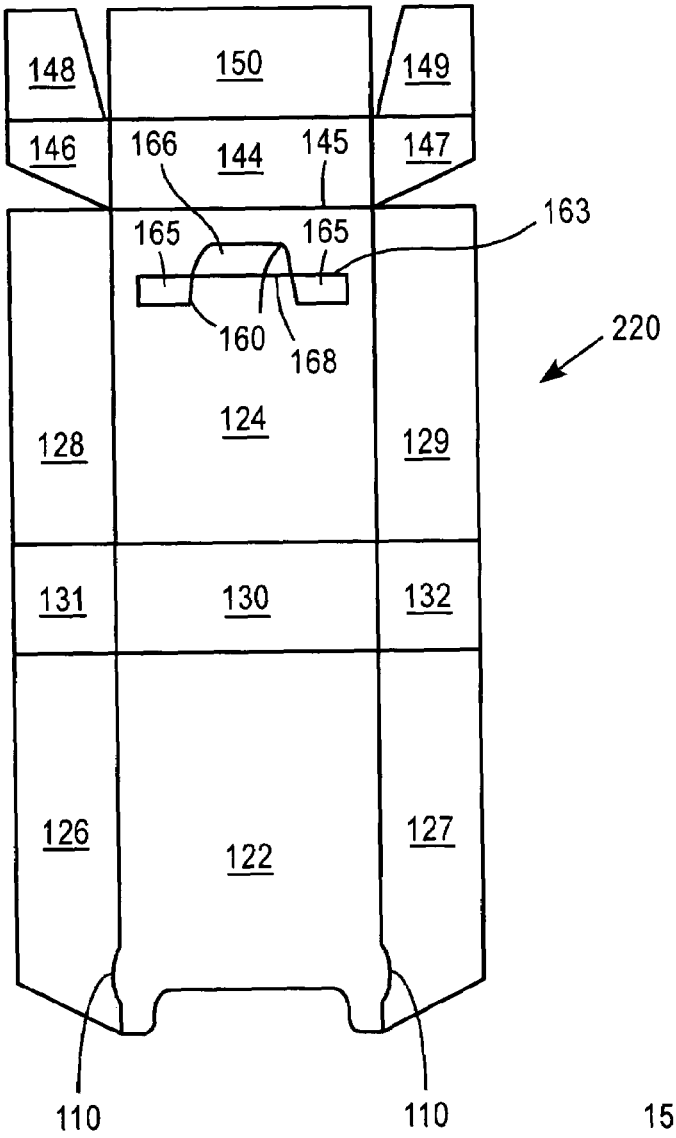
Figure 6B:
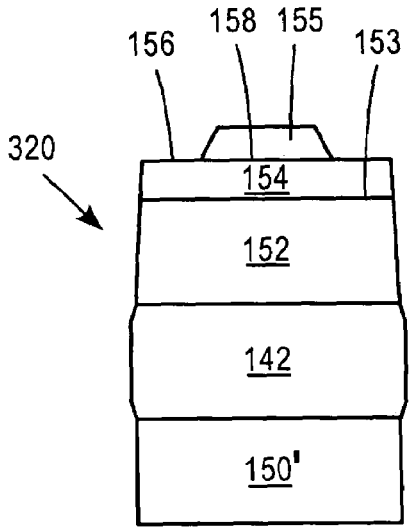

The invention will be further described, by way of example only, with reference to the accompanying drawings in which:

FIG. 1 is a perspective view of the container according to a preferred embodiment of the invention, FIG. 2 is a perspective view of the lower box portion and upper lid portion of the container according to a preferred embodiment of the invention, FIG. 3 is a perspective view of the sliding device according to a preferred embodiment of the invention, FIG. 4 is a view of a laminar cardboard blank for the box part of the container according to a preferred embodiment of the invention, FIG. 5 a view of a laminar cardboard blank for the sliding device of the container according to a preferred embodiment of the invention, FIG. **6*a* is a view of a laminar cardboard blank for the lower box portion of the container according to an alternative embodiment of the invention, and FIG. 6*b*** is a view of a laminar cardboard blank for the upper lid portion of the container according to the alternative embodiment of the invention.

In FIG. 1 the assembled container 1 is shown. The sliding device 80 is slid over the container 10 and is longitudinally movable along the arrow 2 in a first direction down towards the bottom of the container 1 and in a second direction up towards the top of the container 1.

As shown in FIG. 2, the container 1 comprises a lower box portion 20 with a box bottom wall 30, two box side walls 26, 27, a box front wall 22, a box back wall 24.

In the box back wall 24 is a wavelike incision 60 and a common fold line 63, 68 which crosses the wavelike incision 60 such that three stopper flaps 65, 66 are formed when folded along said common fold line 63, 68. Due to the wavelike form of the incision 60 the first stopper flaps 65 are folded along the fold line 63 towards the top of the container 1, whereas the second stopper flap 66 is folded along the fold line 68 towards the bottom of the container 1.

An upper lid portion 40 extends from the box back wall 24 along a hinge fold line 45. The upper lid portion 40 comprises a lid back wall 44, a lid top wall 42 and two lid side walls 46, 47. Additionally the upper lid portion 40 comprises a lid flap 52, 54 consisting of an upper lid flap 52 and a lower lid flap 54. The upper lid flap 52 extends from the lid top wall 42 along the lid upper edge 41 to the back of the upper lid portion 40. The lower-lid flap 54 is separated by a fold line 53 from the upper lid flap 52. A lid end flap 55 extends from that lower lid flap 54 and is bent upward along the fold line 56.

The lid top wall 42 is broader than the box bottom wall 30, extending over the lid side walls 46, 47 and the box side walls 26, 27 by about the thickness of the walls of the sliding device 80. Additionally the box side walls 26, 27 have an incision near the box front wall 22 so that friction flaps 10 are formed on each side of the box front wall 22.

As shown in FIG. 3, the sliding device 80 comprise a slide front wall 82, two slide side walls 86, 87 and a slide back wall 84. A second slide side wall 85 is adhered to one of the slide side walls 86 to form a sleeve. Extending from the slide back wall 84 is a slide top flap 95 folded around the slide top edge 91 inwardly. Also extending from the slide back wall 84 is a slide bottom flap 96 that is folded inwardly around the slide bottom edge 99.

FIG. 4 shows the blank 120 from which the lower box portion 20 and the upper lid portion 40 are made. FIG. 5 shows the blank 180 from which the sliding device 80 is made. Both blanks are preferably made from laminar cardboard. In these FIGS. 4 and 5 the panels and fold lines of the blanks corresponding to walls, flaps and fold lines of the lower box portion 20, the upper lid portion 40 or the sliding device 80 are referred to by the corresponding reference numerals plus 100. For example the box front panel 122 corresponds to the box front wall 22 when the container 1 is erected.

Extending from the box front panel 122 are the box outer side panels 126, 127 and the box bottom panel 130. From the box bottom panel 130 two bottom dust panels 131, 132 extend, which are adhered to the respective box inner side panels 128, 129. Also extending from the box bottom panel is the box back panel 124. Extending from the box back panel are the two box inner side panels 128, 129. The box outer side panels 126, 127 are adhered onto the two box inner side panels 128, 129 respectively. The box back panel is limited on the upper side by a hinge fold line 145 which forms the hinge 45 of the upper lid portion 40.

Extending along the hinge fold line 45 from the box back panel 124 is the lid back panel 144. Extending from the sides of the lid back panel 144 are two lid side panels 146, 147. Extending from these lid side panels 146, 147 is one lid dust flap 148, 149 each. When erecting the container 1 these lid dust flaps 148, 149 are adhered to the lid inner top panel 150 which is extending form the lid back panel 144. From the lid inner top panel 150 extends the lid top panel 142, which is folded 180 degrees backward and adhered onto the lid inner top panel. The lid top panel is extending sideways over the lid inner top panel 150, particularly extending about the thickness of the laminar cardboard or other material the sliding device 80 is made of. Extending from the lid top panel 142 is an upper lid flap panel 152 along fold line 153. From the upper lid flap panel 152 extends a lower lid flap panel 154. Extending form the lower lid flap panel 152 is a lid end flap panel 158 along a fold line 156.

FIGS. 6*a* and 6*b* show an alternative embodiment of the blanks to make the box 20 of the container 1 according to the invention. The difference between the two blanks 220, 320 of FIGS. 6*a* and 6*b* and the blank 120 of FIG. 4 is, that the lid inner top panel 150 of blank 120 is present in the first blank 220 that forms the lower box portion 20 and in the second blank 320 that forms the upper lid portion 40. After forming the lower box portion 20 of the container 1, preferably around a bundle of cigarettes, the second blank 320 of the upper lid portion 40 may be attached to the first blank 220 of the lower box portion by attaching the two lid inner top panels 150, 150' to each other. For example the two lid inner top panels 150, 150' may be glued to each other using glue spots, glue lines or any other suitable glue pattern, or with a double sided sticker. Preferably the two lid inner top panels 150, 150' have substantially the same size. Thereafter the container 1 of this alternative embodiment is assembled like a container 1 with a box 20 made from a single blank 120. Preferably, the manufacturing of the lower box portion is performed automatically in a first step. In a second step, after the two lid inner top panels 150, 150' are attached to each other, the final assembly of the container 1 may be either performed automatically or manually.

The sliding device blank 180 comprises a slide front panel 182. Extending from the slide front panel 182 are two slide side panels 186, 187, a slide inner front panel 183 and two triangular slide inner front panels 190. When the sliding device 80 is assembled from the sliding device blank 180 the slide inner front panel 183 and the two triangular slide inner front panels 190 are bent inward into the sliding device sleeve. By this the nearly the entire inner area of the slide front panel 182 is covered, which strengthens the slide front wall 82.

Extending from one of the slide side panels 187 is the slide back panel 184. Extending from the slide back panel 184 is a slide inner side panel 185, which is adhered to the back of other slide side panel 186, forming the sleeve of the assembled sliding device 80. Also extending from the slide back panel 182 along the fold line 191 is a slide top flap panel 195, forming the slide upper edge 91 in the assembled sliding device 80. Also extending from the slide back panel 182 along the fold line 191 is a slide bottom flap panel 196, forming the slide bottom edge 99 in the assembled sliding device 80.

When the container 1 is assembled and the slide 80 embraces the lower box portion 20 the longitudinally movement of the sliding device 80 along the lower box portion 20 in the first direction towards the bottom of the lower box portion 20 the slide upper flap 95 contacts the lid end flap 55.

When the sliding device 80 is moved further along the first direction towards the bottom of the lower box portion 20, the slide top flap 95 pulls the lower lid flap 54 and upper lid flap 52 along until the movement is stopped by the first stopper flaps 65. By pulling the lower lid flap 54 and upper lid flap 52 into the first direction the upper lid portion 40 pivots about the hinge line 45 and the upper lid flap 52 pivots along the fold line 53.

The opening movement of the upper lid portion 40 is terminated by the interlocking of the outer edge 56 of the lower lid flap 54 and the slide top flap 95 with the first stopper flaps 65. Thus the opening angle of the upper lid portion 40 is defined by the distance the lower lid flap 54 travels into the first direction.

When moving the sliding device in the opposite, second direction towards the upper lid portion 40 of the container 1, the upper edge 91 of the sliding device 80 pushes the upper lid flap 52 in a position parallel to the back wall 24 of the container 1, thereby closing the container 1.

The movement of the sliding device 80 in the second direction is limited by two mechanisms. Firstly the slide bottom flap 96 contacts the second stopper flap 66. Secondly the movement of the sliding device 80 is limited by the lid top panel 42, which extends into the path of the sliding device 80 in the second direction.

The ease of movement of the sliding device 80 in either direction along the lower box portion 20 is controlled by the size of the friction flaps 10 on the side walls 26, 27 of the box, engaging in frictional engagement with the inner surfaces of the slide side walls 86, 87 of the sliding device 80. The longer and higher the friction flaps 10 are, the more friction is created when the sliding device 80 is moved.

The container 1 may be opened by a user by gripping the sliding device 80 and pushing the container 1 with the bottom wall 30 onto a surface.

The invention claimed is:

1. A container comprising a lower box portion, an upper lid portion and a sliding device, wherein said lower box portion comprises a box bottom wall, a box front wall and a box back wall, wherein the upper lid portion is hinged to the box back wall, wherein the sliding device embraces at least partly the lower box portion, wherein the container is opened by moving the sliding device longitudinally along the lower box portion in a first direction and closed by moving the sliding device longitudinally along the lower box portion in a second, opposite direction, wherein the box back wall comprises a first stopper flap limiting the movement of the sliding device in the first direction and a second stopper flap limiting the movement of the sliding device in the second, opposite direction, wherein the first stopper flap and the second stopper flap are formed by a common incision.

2. The container according to claim 1, wherein said sliding device comprises a slide top edge, a slide bottom edge, a slide top flap extending from said slide top edge and a slide bottom flap extending from the slide bottom edge and wherein both slide flaps are bent inwardly into the sliding device.

3. The container according to claim 2, wherein said hinge-lid comprises a lid flap extending from the lid top back edge downwardly beyond said hinge of said hinge-lid, said lid flap further comprising a lid end flap, extending from the lower end of said lid flap and being folded upward such that said slide top flap of said sliding device interlocks with said lid end flap when said sliding device is moved in the first direction so that said hinge-lid is opened.

4. The container according to claim 3, wherein the movement of said sliding device is limited in said first direction by interlocking of the lower end of said lid flap into said first stopper flap and the movement of said sliding device is limited in said second direction by interlocking said bottom flap into the second stopper flap.

5. The container according to claim 1, wherein said sliding device comprises a slide front panel and a slide inner front panel extending from the slide front panel, folded by 180 degrees into said sliding device.

6. The container according to claim 1, wherein said hinge-lid comprises a top panel and a side panel, wherein said top panel extends sideways over said side panel to limit movement of the sliding device in said second direction.

7. The container according to claim 1, wherein the box further comprises a friction element to increase the friction between the box and said sliding device during the movement of said sliding device in either said first direction or said second direction.

8. The container according to claim 1, wherein said sliding device covers only part of said box.

9. The container according to claim 1, wherein said box and said sliding device are made from separate blanks which are not adhered to each other.

10. The container according to claim 1, wherein said lower box portion and said upper lid portion are made from separate blanks which are adhered to each other.

11. The container according to claim 1, wherein the container is a cigarette container or a container for other smoking articles.

12. Blank for making a lower box portion for a container comprising a lower box portion, an upper lid portion and a sliding device, wherein said lower box portion comprises a box bottom wall, a box front wall and a box back wall, wherein the upper lid portion is hinged to the box back wall, wherein the sliding device embraces at least partly the lower box portion, wherein the container is opened by moving the sliding device longitudinally along the lower box portion in a first direction and closed by moving the sliding device longitudinally along the lower box portion in a second, opposite direction, wherein the box back wall comprises a first stopper flap limiting the movement of the sliding device in the first direction and a second stopper flap limiting the movement of the sliding device in the second, opposite direction, wherein the first stopper flap and the second stopper flap are formed by a common incision, wherein said blank comprises a panel forming said box back wall, said panel includes the incision forming the at least two stopper flaps, the stopper flaps pointing in opposite directions.

13. A container comprising a lower box portion, an upper lid portion and a sliding device, wherein said lower box portion comprises a box bottom wall, a box front wall and a box back wall, wherein the upper lid portion is hinged to the box back wall, wherein the sliding device embraces at least partly the lower box portion, wherein the container is opened by moving the sliding device longitudinally along the lower box portion in a first direction and closed by moving the sliding device longitudinally along the lower box portion in a second, opposite direction, wherein the box back wall comprises a first stopper flap limiting the movement of the sliding device in the first direction and a second stopper flap limiting the movement of the sliding device in the second, opposite direction, and wherein the lower box portion is formed from a first blank and the upper lid portion is formed from a second blank.

14. A container comprising a lower box portion, an upper lid portion and a sliding device, wherein said lower box portion comprises a box bottom wall, a box front wall and a box back wall having a nominal length, wherein the upper lid portion is hinged to the box back wall, wherein the sliding device has a length less than the nominal length and embraces at least partly the lower box portion, wherein the container is opened by moving the sliding device longitudinally along the lower box portion in a first direction and closed by moving the sliding device longitudinally along the lower box portion in a second, opposite direction, wherein the box back wall includes a first stopper flap limiting the movement of the sliding device in the first direction and a second stopper flap limiting the movement of the sliding device in the second, opposite direction, and wherein the first stopper flap and the second stopper flap are formed by a common incision.

* * * * *